US006827401B2

(12) United States Patent
Marshall et al.

(10) Patent No.: US 6,827,401 B2
(45) Date of Patent: Dec. 7, 2004

(54) LEAF SPRING ROCKER MECHANISM FOR A RECLINING CHAIR

(75) Inventors: Richard E. Marshall, Monroe, MI (US); Michael E. Mohn, Monroe, MI (US); Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 09/981,452

(22) Filed: Oct. 17, 2001

(65) Prior Publication Data

US 2003/0071502 A1 Apr. 17, 2003

(51) Int. Cl.[7] ..... A47C 1/02; A47C 3/026

(52) U.S. Cl. ..... 297/302.1; 297/325

(58) Field of Search ..... 297/302.1, 302.3, 297/325; 248/133, 372.1

(56) References Cited

U.S. PATENT DOCUMENTS

| | | | | | |
|---|---|---|---|---|---|
| 354,044 | A | | 12/1886 | Connolly et al. | |
| 955,220 | A | * | 4/1910 | Stewart | 248/618 |
| 2,313,559 | A | | 3/1943 | Larsen et al. | |
| 2,353,737 | A | | 7/1944 | Lorenz | |
| 2,362,746 | A | | 11/1944 | De Vries | |
| 3,053,570 | A | | 9/1962 | Fox | |
| 3,297,360 | A | | 1/1967 | Holmstrom | |
| 3,337,265 | A | | 8/1967 | Benzing | |
| 3,548,810 | A | | 12/1970 | Hoyer | |
| 3,773,383 | A | | 11/1973 | Ekornes | |
| 3,912,327 | A | | 10/1975 | Johnson | |
| 4,119,343 | A | * | 10/1978 | Pentzien | 297/268.1 |
| 4,141,530 | A | * | 2/1979 | Ward | 248/592 |
| 4,372,606 | A | | 2/1983 | Faull | |
| 4,411,468 | A | | 10/1983 | Apissomian | |
| 4,577,907 | A | | 3/1986 | Talmon et al. | |
| 4,718,723 | A | | 1/1988 | Bottemiller | |
| D295,583 | S | | 5/1988 | Conn | |
| 4,786,106 | A | | 11/1988 | Bottemiller | |
| 4,852,943 | A | * | 8/1989 | Roper | 297/303.1 |
| 4,984,846 | A | | 1/1991 | Ekornes | |
| D316,936 | S | | 5/1991 | Ekornes et al. | |
| 5,039,164 | A | | 8/1991 | Gibbs | |
| 5,040,846 | A | | 8/1991 | Finney et al. | |
| 5,112,106 | A | | 5/1992 | Asbjornsen et al. | |
| D335,038 | S | | 4/1993 | Tseng | |
| D335,039 | S | | 4/1993 | Tseng | |
| D340,361 | S | | 10/1993 | Tseng | |
| 5,263,677 | A | | 11/1993 | Puerner | |
| 5,472,261 | A | | 12/1995 | Oplenskdal et al. | |
| 5,599,064 | A | | 2/1997 | Vanderminden, Sr. | |
| 5,649,740 | A | * | 7/1997 | Hodgdon | 297/303.1 |

* cited by examiner

*Primary Examiner*—Peter R. Brown
(74) *Attorney, Agent, or Firm*—Harness, Dickey & Pierce, P.L.C.

(57) ABSTRACT

A rocker mechanism is provided for implementation with a chair assembly to enable forward and rearward rocking thereof. The rocker mechanism includes upper and lower castings resiliently interconnected by a pair of leaf springs extending at an angle therebetween. The leaf springs are assembled between the upper and lower castings to define first and second effective lengths of each leaf spring for providing first and second spring rates of each leaf spring. In this manner, rocking motion in a first direction may be more difficult than rocking motion in a second direction. Further, the angular configuration of the leaf springs between the upper and lower castings enables maximization of the lengths of the leaf springs within the rocker mechanism.

23 Claims, 9 Drawing Sheets

LEAF SPRING ROCKER MECHANISM FOR A RECLINING CHAIR

FIELD OF THE INVENTION

The present invention relates to reclining chairs and more particularly to a rocker mechanism for a reclining chair.

BACKGROUND OF THE INVENTION

Rocking-type chairs typically include a rocker spring mechanism disposed between a stationary base and lower structure of a chair frame for biasing the chair in an upright, neutral position while enabling the chair to rock forwardly and rearwardly. As a seat occupant rocks, the chair follows the contour of a rocker mechanism. Traditional rocker mechanisms generally include a spring box design including two opposed panels linked together with a rod that provides a pivot for the two panels for forming a "rocker box". To provide control and support for relative rocking motion between the opposed panels, a plurality of coil springs are contained within the rocker box, resiliently interconnecting the opposed panels. Forward and rearward rocking causes compression and elongation of the various springs.

There are several disadvantages associated with traditional rocker mechanisms. One of these includes limited rocking motion as a result of a limited rocking radius. In order to achieve a larger rocking radius, traditional rocker mechanisms must be increased in size. The distance between the opposed panels must be increased and longer springs implemented within the rocker box. Further, traditional rocker mechanisms typically implement metal coil springs for providing resiliency. The nature of such springs, as well as their interaction with other components of the rocker mechanism, results in undesirable noise as the rocker mechanism is caused to function. Finally, traditional rocker mechanisms tend to include a significant amount of components. The number of components increases manufacturing complexity, and therefore manufacturing cost, in addition to increasing component cost.

Therefore, it is desirable in the industry to provide an improved rocker mechanism. The improved rocker mechanism should eliminate the disadvantages associated with prior rocker mechanisms, including noise and limited rocking motion. Further, the improved rocking mechanism should be more compact and less complex for reducing overall cost.

SUMMARY OF THE INVENTION

Accordingly, the present invention provides a rocker mechanism adapted for operably interconnecting a chair to a base. The rocker mechanism includes an upper casting adapted for interconnection with the chair, a lower casting adapted for interconnection with the base and a leaf spring interconnecting the upper and lower castings. The leaf spring is secured to the upper and lower castings in such a manner that the rate of the spring varies as a function of the direction of rocking. The leaf spring includes first and second effective lengths defining first and second effective spring rates, thereby providing a dual-rate leaf spring. The first effective length of the first leaf spring is defined as a distance between a spring seat face of the upper casting and a spring seat face of the lower casting. The second effective length of the first leaf spring is defined as a distance between connection points of the first leaf spring to the upper casting and the lower casting.

The present invention further provides a rocker mechanism adapted for operably interconnecting a chair to a base including an upper casting, a lower casting, and first and second leaf springs interconnecting the upper and lower castings for relative rocking motion therebetween, whereby the first and second leaf springs extend angularly between the upper and lower castings for maximizing the length of each of the first and second leaf springs.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
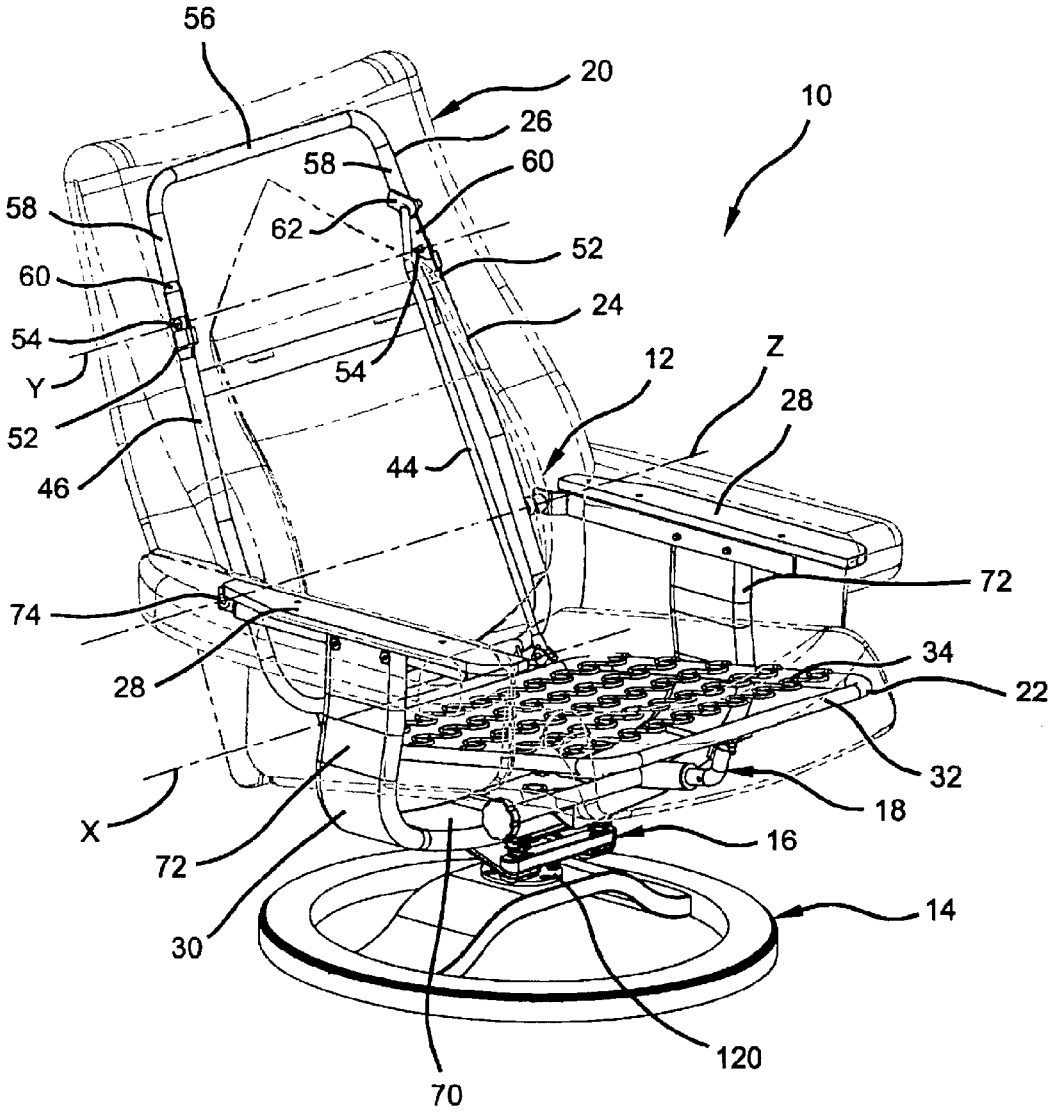
FIG. 1 is a perspective view of a chair assembly incorporating a leaf spring rocker mechanism in accordance with the principles of the present invention, the padding being shown in phantom for sake of clarity.

The following description of the preferred embodiment is merely exemplary in nature and is in no way intended to limit the invention, its application, or uses.

With reference to the Figures, a chair assembly 10 is shown. The chair assembly 10 includes a chair frame 12 operably attached to a supporting base 14 by a rocker mechanism 16. The rocker mechanism 16 enables rocking and swivel motion of the chair frame 12 relative to the base 14. A recliner mechanism 18 is provided for enabling selective reclining of the chair frame 12. The chair frame 12 is preferably covered with padding 20, as shown in phantom, providing occupant comfort.

The chair frame 12 includes a seat frame 22, a seat back frame 24, a headrest frame 26, a pair of armrests 28 and a U-shaped support 30. The individual frames 22, 24, 26 of the chair frame 12 are operably interconnected and supported by the U-shaped support 30 and recliner device 18. As discussed in further detail below, using the recliner mechanism 18, the chair frame 12 may be selectively positioned in a plurality of recline positions. As the chair frame 12 is caused to recline, the chair frame components operably interact to define the recline position.

The seat frame 22 includes a tubular frame rail 32 defining a rectangular perimeter. A series of serpentine seat springs 34 traverse the rectangular perimeter, providing resilient seating support. A back edge 36 of the seat frame 22 includes a pair of extending pivot supports 38, to which the seat back frame 24 is pivotally connected. A front edge 40 of the seat frame 22 is fixedly attached to the recliner mechanism 18, as described in further detail hereinbelow. Also extending from the seat frame 22 is a linkage rod attachment 42 for pivotally attaching a linkage rod 44 to the seat frame 22.

The seat back frame 24 includes a tubular frame rail 46 defining a U-shaped perimeter. A bottom edge 48 of the seat back frame 24 includes a pair of extending pivot supports 50, corresponding to the pivot supports 38 of the seat frame 22 for pivotally interconnecting the seat and seat back frames 22,24 about a pivot axis X. Ends 52 of the U-shaped seat back frame 24 include pivot attachment points 54 for pivotal attachment of the headrest frame 26 to the seat back frame 24.

The headrest frame 26 includes a tubular frame rail 56 defining a U-shaped perimeter. Ends 58 of the U-shaped headrest frame 26 are pivotally attached to the seat back frame 24 at the pivot attachment points 54 of rotation about an axis Y. A linkage rod attachment 62 extends from one side of the headrest frame 26 for pivotally attaching the linkage rod 44 to the headrest frame 26. The linkage rod 44 operably interconnects the headrest frame 26 and the seat frame 22 for articulation of the headrest frame 26 during reclining of the chair frame.

Figure 8:
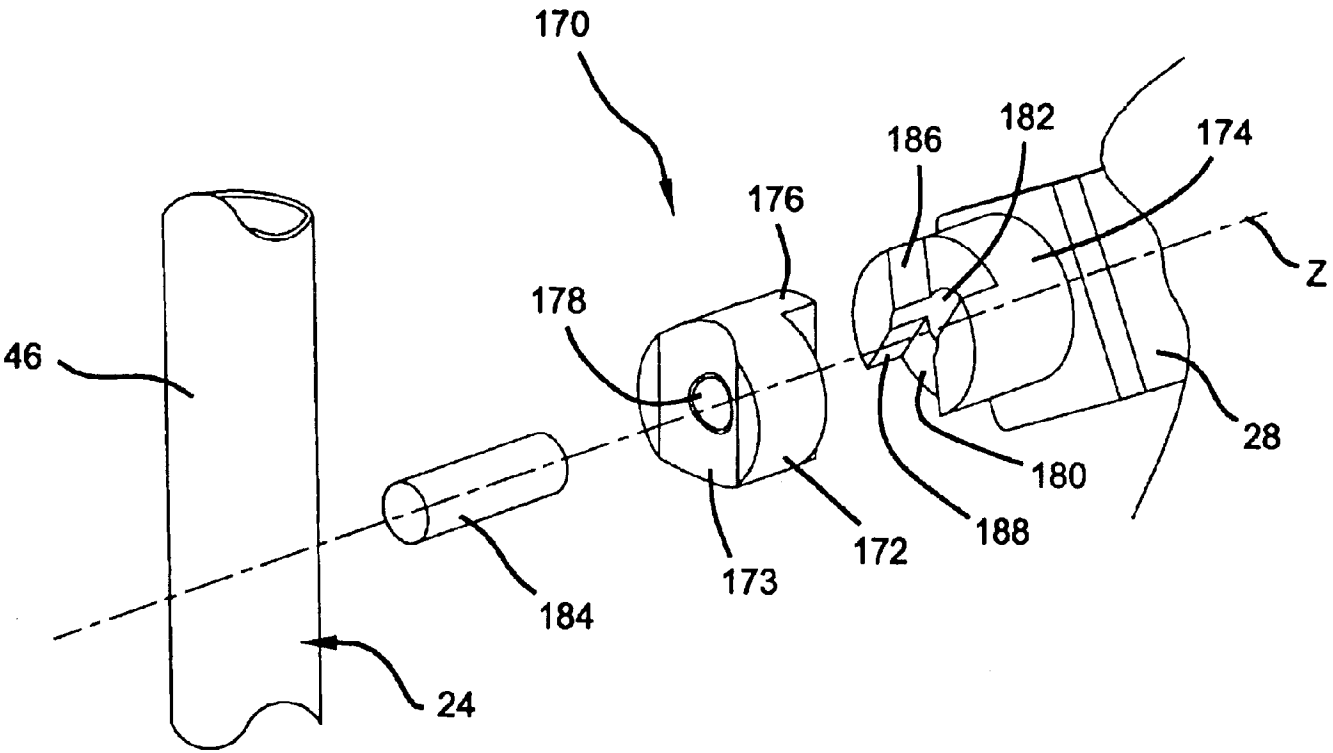
FIG. 8 is a detailed view showing the recline stop mechanism of the present invention.

The U-shaped support 30 includes a flat base length 70 and upward extending ends 72. The armrests 28 are respectively fixed to the ends 72 and extend backward for pivotal attachment with the seat back frame 24 at respective pivot points 74. In this manner, the seat back frame 24 is pivotally supported by the armrests 28 about a pivot axis Z. A recline stop mechanism 170 is operably disposed between armrests 28 and seat back frame 24. With reference to FIG. 8, recline stop mechanism 170 includes stop end 172 secured to seat back frame 24 and stop slot 174 secured to armrest 28. Stop end 172 has a contoured face 173 which engages frame member 46, a blade 176 portion and an aperture 178 formed therethrough. Stop slot 174 has a wedged-shaped slot 180 and an aperture 182 formed therethrough. Pivot pin 184 is received within apertures 178 and 182 to pivotally connect seat back frame 24 with armrest 28.

During reclining motion, seat back frame 24 and stop end 172 pivot relative to stop slot 174 and armrest 28. The limit of reclining motion is defined when blade 176 engages the interior faces 186, 188 of slot 178. Specifically, the maximum recline limit is defined when blade 176 engages face 186 and the minimum recline or upright position is defined when blade 176 engages face 188. Recline stop mechanism 170 provides a mechanism which is compact and may be concealed within the padding and upholstery of the chair. Recline stop mechanism 170 further provides an effective means for limiting the range of reclining motion of seat back frame 24, thereby preventing pivot point 36 from moving overcenter of a line between pivot point 74 and the forward portion 40 of seat frame 22.

Figure 9:
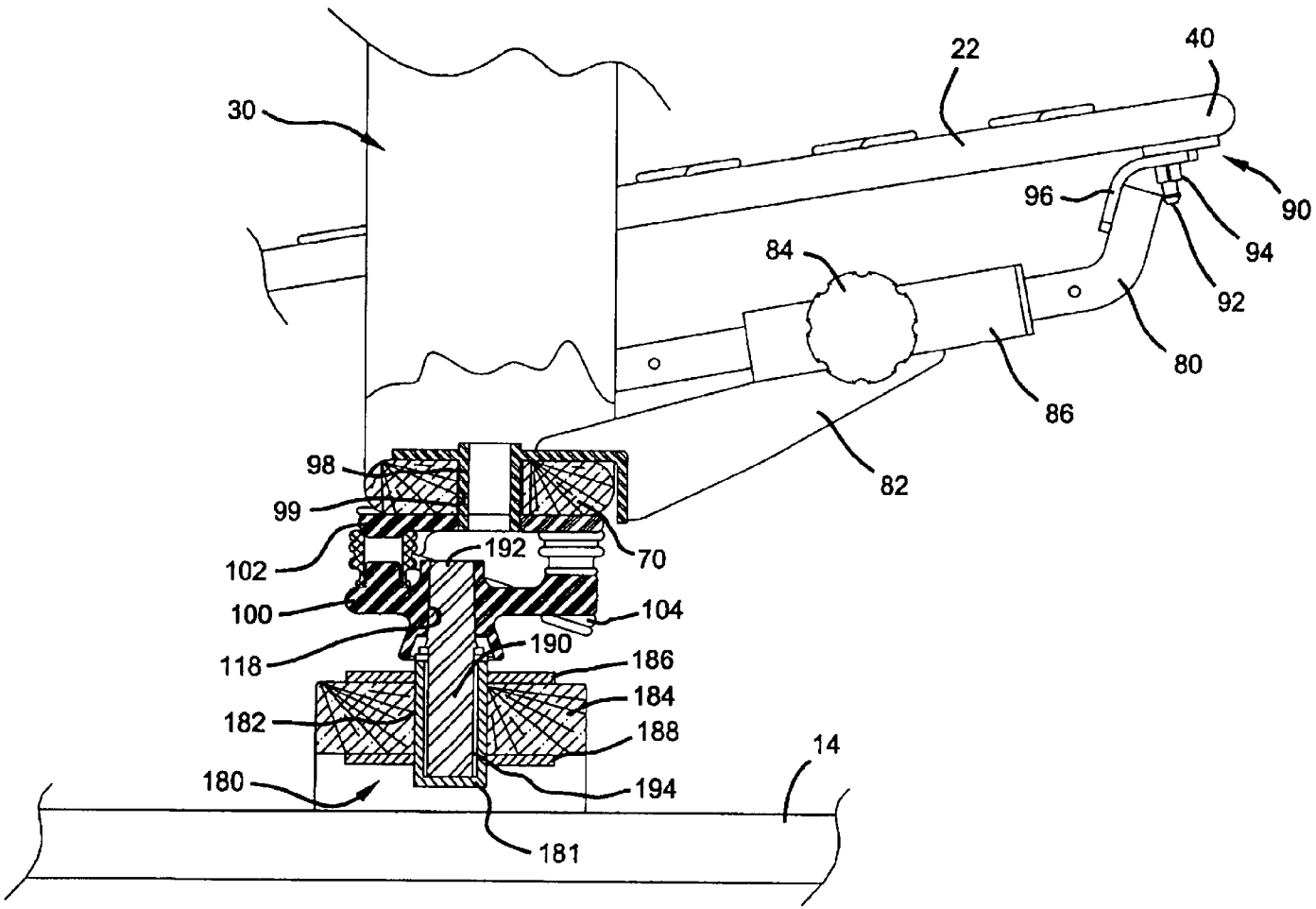
FIG. 9 is a cross-sectional view illustrating the reclining mechanism and spindle subassembly of the present invention.

The recliner mechanism 18 interconnects the flat base length 70 of the U-shaped support 30 and a forward portion 40 of the seat frame 22, thereby supporting the seat frame 22. The recliner mechanism 18 includes a recliner slide 80 slidably supported within a tubular member 86 secured on support bracket 82. As best seen in FIG. 9, the front end of slide 80 is coupled to the forward portion 40 of seat frame 22 at joint 90. Joint 90 includes a member 92 extending from forward portion 40 which is received in a bushing 94 located in bracket 96. Member 92 and bushing 94 provides relative movement between seat frame 22 and support bracket 82 to allow reclining motion. Spindle 98 extends from support bracket 82 and received within an aperture 99 in flat base length 70 of support 30.

A tension control mechanism 84 is operable to adjust the friction between slide 80 and tubular member 86. Tightening tension control mechanism 84 increases the friction between slide 80 and tubular member 86, thereby increasing the force required to initiate reclining motion. Conversely, loosening the tension control mechanism decreases the friction between slide 80 and tubular member 86, thereby decreasing the force required to initiate reclining motion.

In accordance with the present invention, recliner mechanism 18 is designed to optimize the ease of reclining operation. The kinematics of recliner mechanism 18 are such that the feet of a seated occupant can remain in contact with the floor during the range of reclining motion. To this end, tubular member 86 is oriented at a relatively shallow angle, approximately 10° from a horizontal (I.e., floor) plane. As a result, vertical movement of the forward portion 40 of seat frame 22 is minimized during reclining motion. Likewise, the swing link of recliner mechanism 18 (i.e., the bottom portion of tubular frame member 46 between pivot axis Z and pivot axis X) is configure such that the vertical movement of the rearward portion of the seat frame 22 approximates the vertical movement of the forward portion 40 of seat frame 22. In this manner, the seat frame 22 maintains a generally constant angular orientation with respect to the horizontal plane throughout the range of reclining motion. Thus, seat frame 22 moves primarily in translation forward and rearward with minimal vertical and rotation movement through the range of reclining motion.

Furthermore, recliner mechanism 18 is configured such that it may be readily adapted for use with a variety of frame sizes. More particularly, chair frame 12 is operably supported from support 30 at two locations—pivot 74 and joint 90. Adjustment of the relative location of these points readily adapts recliner mechanism 18 for a different frame size. For example, a chair frame having a deeper seat frame is accommodated by shifting armrest 28 rearward with respect to end 72 of support 30 and by shifting tubular member 86 forward with respect to support bracket 82. In this manner, pivot 74 and joint 90 are further separated to accommodate the deeper seat assembly.

Figure 2:
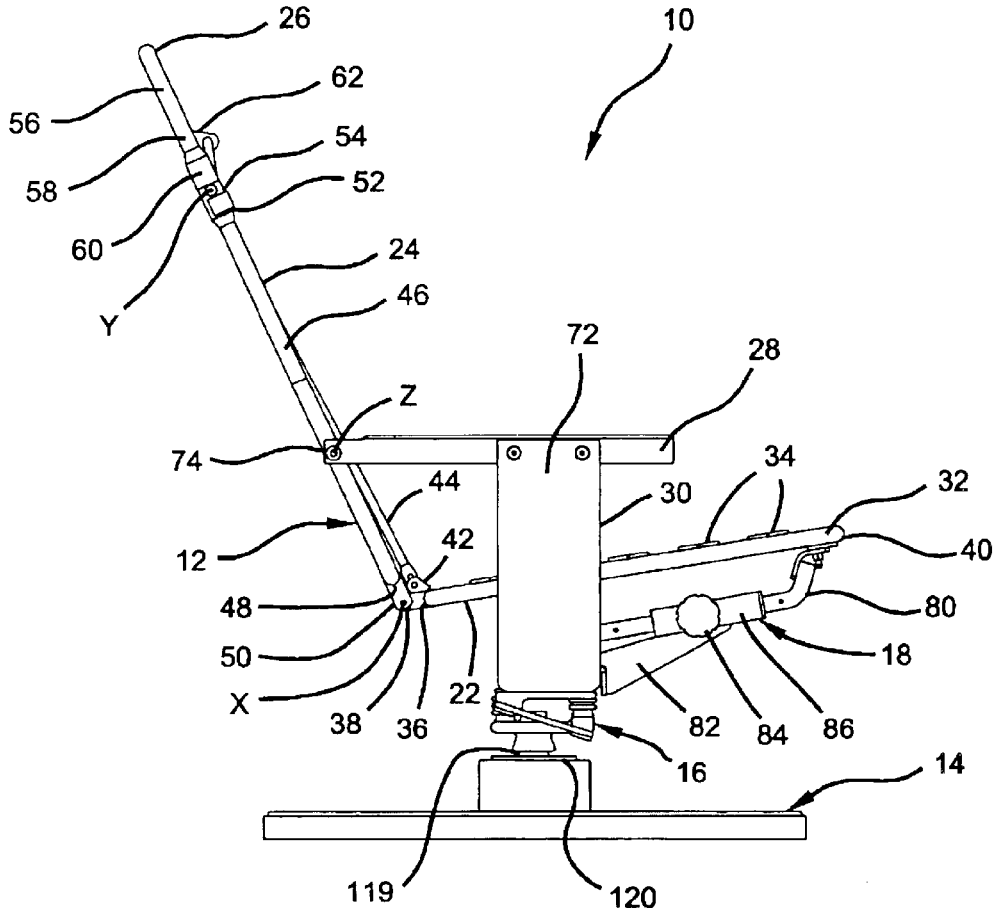
FIG. 2 is a side view of the chair assembly of FIG. 1.
Figure 7:
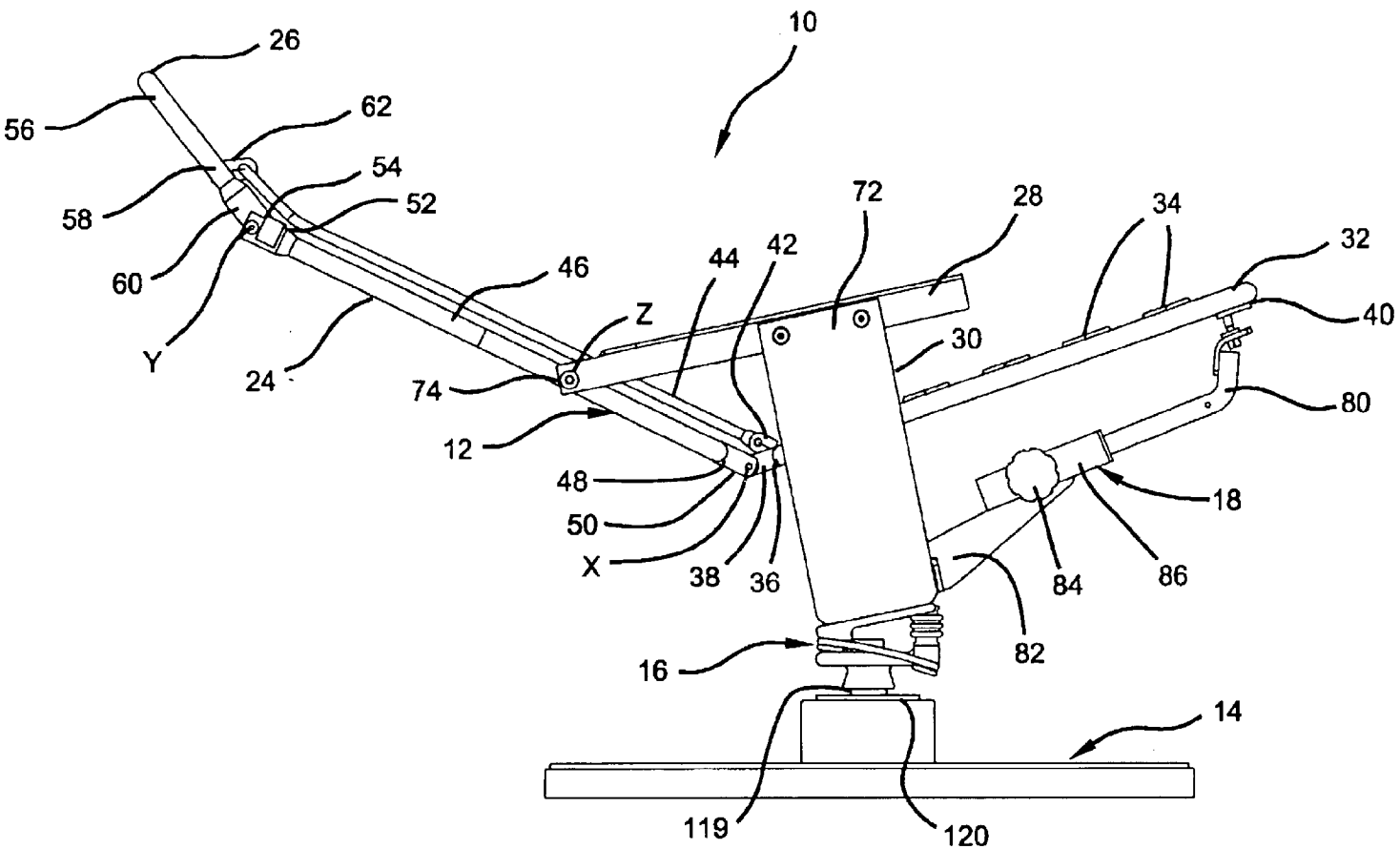
FIG. 7 is a side view of the chair assembly reclined and in a rearward rock position.

With particular reference to FIGS. 2 and 7, the chair frame 12 is respectively shown in a normal or upright position and a maximum reclined position. As the chair frame 12 is caused to recline, the seat back frame 24 pivots counterclockwise, with reference to the views of FIGS. 2 and 7, about the pivot axis Z. Concurrently, the seat frame 22 travels forward and slightly upward through the U-shaped support 30 through relative pivoting of the seat back frame 24 about pivot axis X and forward sliding of the recliner slide 80 within the tubular length 86. Movement of the seat frame 22 results in corresponding movement of the linkage rod 44. Thus, forward travel of the seat frame 22 results in a downward motion on the linkage rod 44, thereby pivoting the headrest frame 26 about the pivot axis Y. In this manner, as the seat back frame 24 and seat frame 22 are caused to recline, the headrest frame 26 is caused to pivot in a clockwise direction (as seen in FIGS. 2 and 7) to a forward position for providing increased head support for an occupant.

As the chair frame 12 returns to the upright position, the seat back frame 24 pivots clockwise about the pivot axis Z.

Concurrently, the seat frame 22 travels rearward through the U-shaped support 30 with relative pivoting of the seat back frame 24 about the pivot axis X and rearward sliding of the recliner slide 80 within the tubular length 86. Rearward travel of the seat frame 22 results in an upward motion on the linkage rod 44, thereby pivoting the headrest frame 26 about the pivot axis Y. In this manner, as the seat back frame 24 and seat frame 22 are caused to return to the normal position, the headrest frame 26 is caused to pivot to a return position. The tension control mechanism 84 may tightened or loosened to adjust the ease of initiating reclining motion.

Figure 3:
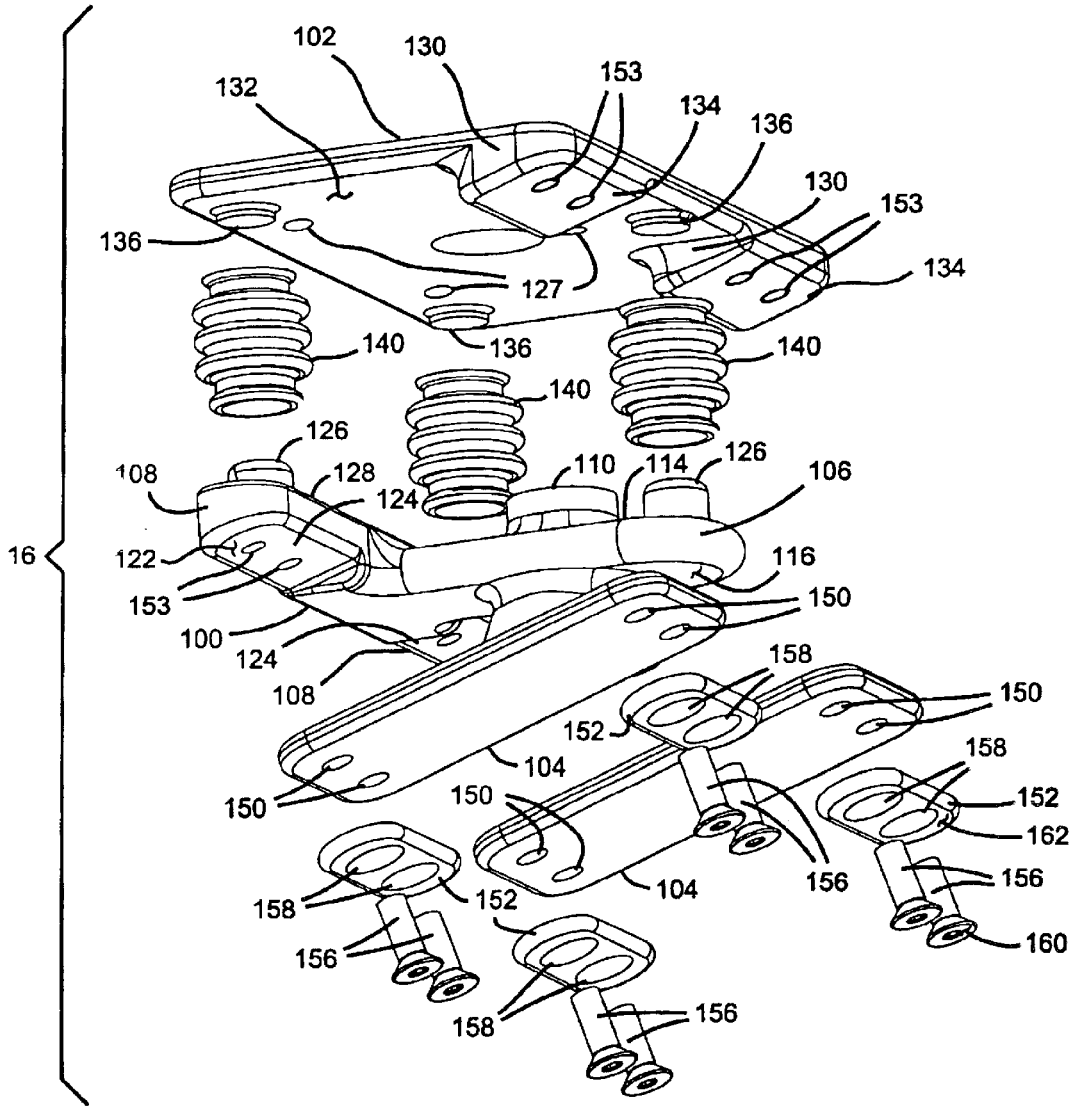
FIG. 3 is an exploded perspective view of the leaf spring rocker mechanism.
Figure 4:
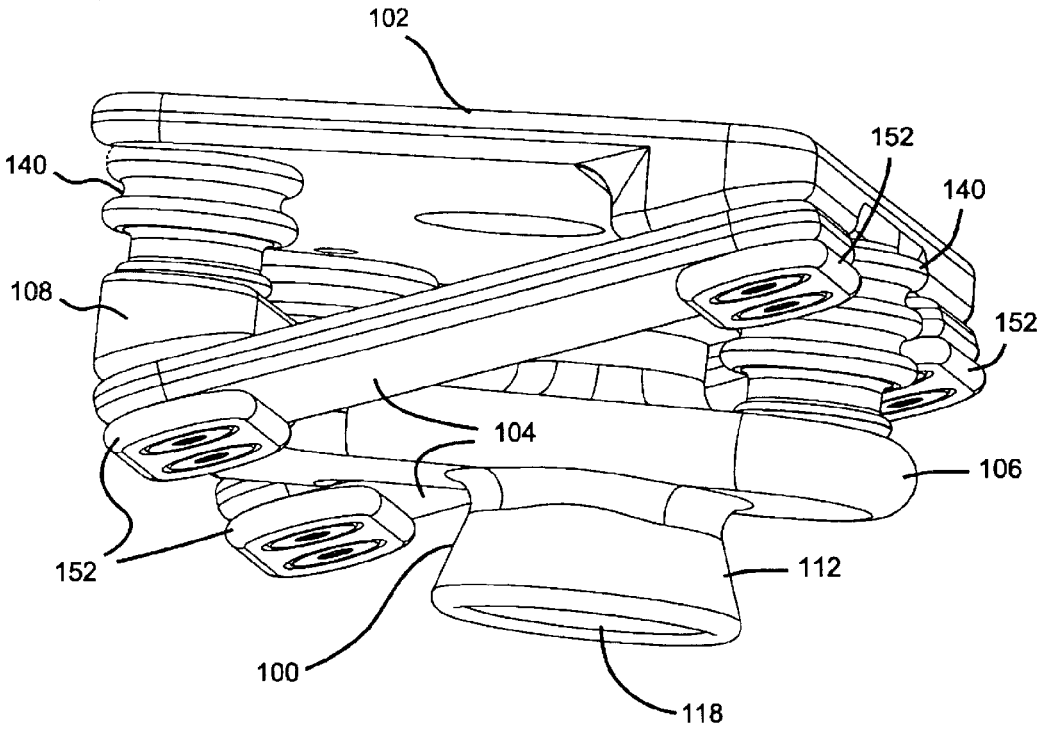
FIG. 4 is a perspective view of the assembled leaf spring rocker mechanism.
Figure 5:
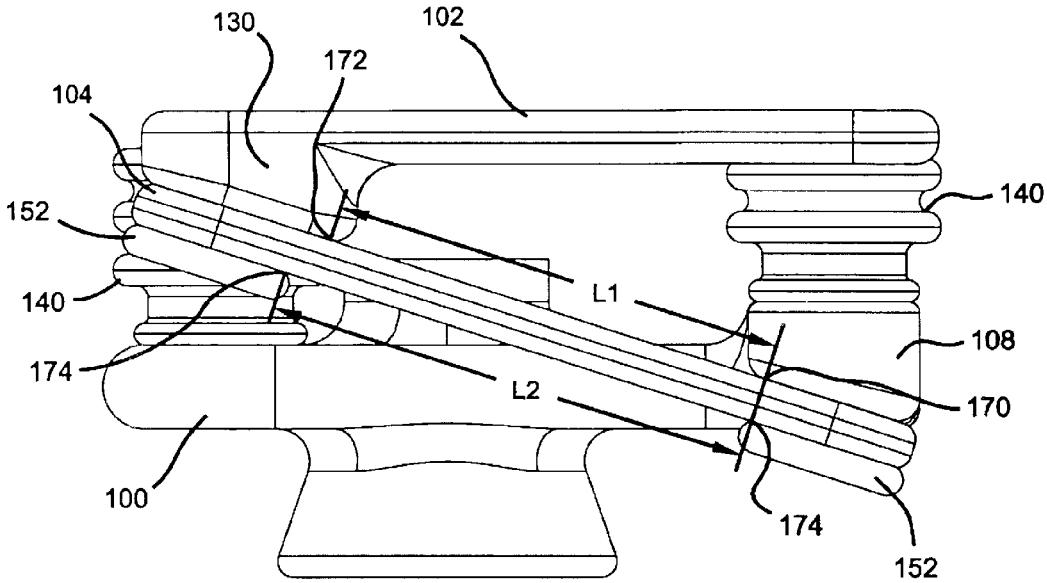
FIG. 5 is a side view of the leaf spring rocker mechanism.

As discussed above, the rocker mechanism 16 operably interconnects the chair frame 12 and the supporting base 14, enabling rocking motion therebetween. With particular reference to FIGS. 3 through 5, the rocker mechanism 16 includes a lower casting 100 and an upper casting 102 that are interconnected by a pair of resilient leaf springs 104. The leaf springs 104 enable rocking motion of the upper casting 102 relative to the lower casting 100, thereby providing rocking motion of the chair frame 12 relative to the supporting base 14. The lower casting 100 is operably attached to the base 14 by a spindle subassembly 180 for providing the swivel motion between the chair frame 12 and supporting base 14.

With reference now to FIG. 9, the spindle subassembly includes 180 a cylindrical housing 181 extending through a hole 182 formed in cross-member 184 of base 14. Housing 180 is configured to be press fit into hole 182. A pair of plates 186,188 are disposed on the lower and upper faces of cross-member 184 and support cylindrical housing 180. A spindle 190 is received in cylindrical housing 180, extends upwardly above cross-member 184. A bushing 194 is operably disposed between housing 180 and spindle 190 to permit relative rotation therebetween. Plates 186,188 in combination with cross-member 184 function to react the bending moment transferred from spindle 190 to base 14 during rocking and reclining motion of chair 10.

The lower casting 100 is generally T-shaped having a central stem portion 106 with wing portions 108 extending perpendicularly therefrom. The central stem portion 106 includes upper and lower skirts 110,112 respectively extending from top and bottom surfaces 114,116 of the central stem portion 106 and having a tapered aperture 118 disposed therethrough. Spindle 190 has a tapered end portion 192 (as best seen in FIG. 9) which is received into the aperture 118 for fixedly interconnecting rocker mechanism 16 to spindle subassembly 180. In this manner, rocker mechanism 16, and hence chair frame 12 is rotatably supported on a spindle subassembly 180.

A bottom face 122 of each of the wing 108 portions defines an angularly sloping spring seat face 124. The slope of the spring seat face 124 defines the slope at which the leaf spring 104 extends in an upward direction to the upper casting 102, as described in further detail hereinbelow. A plurality of stops 126 extend upward from a top surface 128 of the lower casting 100 and are preferably disposed at the wing portions 108 and a distal end of the central stem portion 106. The stops 126 limit the degree of rocking motion between the upper and lower castings 102,100, as discussed in further detail below.

The upper casting 102 is generally rectangular in shape and includes spring seats 130 formed from a bottom surface 132, each having an angularly sloping spring seat face 134. The slope of the spring seat faces 134 and the slope of the spring seat faces 124 of the lower casting 100 are oriented approximately 1°–2° relative to one another to provide preloading of the leaf springs 104 once the weight of the chair frame 12 with padding 20 is applied. Thus, the chair 10 is properly oriented when fully assembled. A plurality of raised stop lands 136 are also formed from the bottom surface 132 of the upper casting 102 and selectively contact the stops 126 of the lower casting 100, as described in further detail hereinbelow. The upper casting 102 includes a plurality of apertures 127, through which screws (not shown) are received for fixing the U-shaped support 30 to the recliner mechanism 16. In this manner, the chair frame 12 is fixed for rocking motion with the recliner mechanism 16.

A plurality of bellowed boots 140 are disposed between the upper and lower castings 102,100. Each boot 140 is associated with a stop 126 and stop land 136 set. The boots 140 minimize the likelihood that a foreign object will be introduced between the stop 126 and corresponding stop land 136. Such foreign objects may inhibit the range of rocking motion of the chair frame 12 relative to the base 14. The boots 140 also serve as a safety feature for preventing accidents such as a finger being pinched between the stop 126 and corresponding stop land 136.

The leaf springs 104 extend between the spring seat faces 134 of the upper casting 102 and the spring seat faces 124 of the lower casting 100, at an angle of approximately 10°–20° and preferably about 16°. Ends of the leaf springs 104 include a pair of screw apertures 150 therethrough and are fixedly attached to the spring seat faces 124,134 by a plurality of rectangular shaped reinforcement plates 152 and associated screws 156. The screws 156 are received through countersunk apertures 158 of the reinforcement plates 152, through the apertures 150 of the leaf springs 104 and threaded into apertures 153 of the upper and lower castings 102,100. The reinforcements plates 152 distribute the clamping force about a surface area of the end of the leaf springs 104, thereby reducing stress concentrations at the connection points and increasing the durability of the leaf springs 104. The screws 156 are preferable tapered for engaging the countersunk apertures 158 of the reinforcement plates 152, whereby a top surface 160 of the screw heads conform to a top surface 162 of the reinforcement plates 152.

A skilled practitioner will recognize that angular orientation of the leaf springs 104 between the upper and lower castings 102,100 enables maximization of the leaf spring lengths within the rocker mechanism 16. Maximization of the leaf spring lengths provides improved spring rates while minimizing the overall size of the rocker mechanism 16. Further, the leaf spring length provides for a larger rocking radius than would be achievable for a comparatively sized traditional rocker mechanism. In this manner, the present invention provides for improved rocking characteristics achieved via a more compact rocker mechanism.

A skilled practitioner will also recognize that the effective length of a leaf spring has a direct impact on its spring rate which is defined as the force required to deflect the spring a given distance. All other parameters being the same, a relatively longer leaf spring has a lower spring rate and a relatively shorter leaf spring has a higher spring rate. In other words, the spring rate of a leaf spring is inversely proportional to its length. With respect to FIG. 5 (which is an opposite side view of the mechanism shown in FIGS. 3 and 4), the leaf springs 104 include first and second effective lengths L1,L2 for providing first and second spring rates. The first effective length L1 is defined by the distance between a point of intersection 170 between spring seat face 124 and spring 104 and a point of intersection 172 between spring seat face 134 and spring 104. The second effective length L2 is defined by the distance between the points of intersection 174 between the spring 104 and its reinforcement plates 152. The first effective length L1 is shorter than the second effective length L2 and thus, the first spring rate is higher than the second spring rate. As a result of this dual-rate design, the biasing force generated by the leaf springs 104 in the direction of the first effective length L1 (i.e., rocking forward) is greater than the biasing force generated by the leaf spring 104 in the direction of the second effective length L2 (i.e. rocking rearward) for a given displacement.

In the presently preferred embodiment, leaf spring 104 is a composite leaf spring having an overall length of 4.5" a width of 2.5" and a thickness of 0.25". The first effective length $L_1$ is approximately 3.1" and the second effective length $L_2$ is approximately 3.3". Thus, the first spring rate is approximately 10% higher than the second spring rate.

Figure 6:
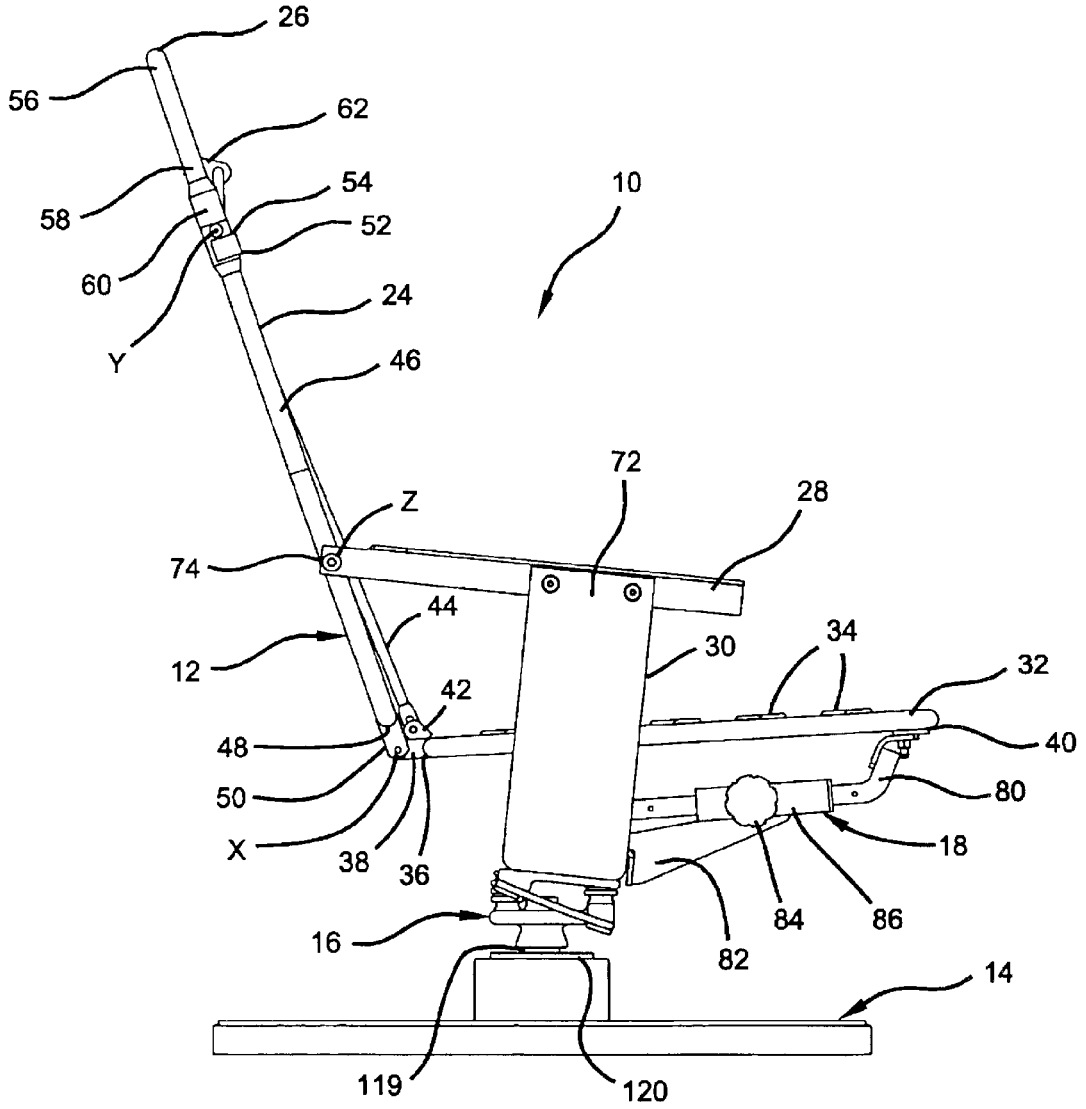
FIG. 6 is a side view of the chair assembly upright and in a forward rock position.

As best seen in FIGS. 6 and 7, forward and rearward rocking of the chair assembly 10 are respectively shown. Forward rocking of the chair assembly 10 causes upward flexure of the leaf springs 104. As the chair assembly 10 rocks forward, the upper casting 102 rotates clockwise (as seen in FIG. 6) relative to the lower casting 100 until the forward stop 126 of the lower casting 100 contacts the forward stop land 136 of the upper casting 102, thereby prohibiting further forward rocking. Rearward rocking of the chair assembly 10 causes downward flexure of the leaf springs 104. As the chair assembly 10 rocks rearward, the upper casting 102 rotates counterclockwise (as seen in FIG. 7) until the rearward stops 126 contact the rearward stop lands 136, thereby prohibiting further rearward rocking of the chair assembly 10.

The description of the invention is merely exemplary in nature. For example, a skilled practitioner will recognize that the various components of the present invention such as the recliner mechanism, the rocker mechanism and the spindle subassembly may be utilized alone or in various combinations thereof. Thus, variations that do not depart from the gist of the invention are intended to be within the scope of the invention. Such variations are not to be regarded as a departure from the spirit and scope of the invention.

What is claimed is:

1. A rocker mechanism adapted for operably interconnecting a chair to a base, comprising:

an upper casting adapted for interconnection with the chair;

a lower casting adapted for interconnection with the base;

a stop defined in one of a top surface of said lower casting and a bottom surface of said upper casting; and a first dual-rate leaf spring having a first end anchored to said upper casting on a first surface of said first dual-rate leaf spring and a second end anchored to said lower casting on said first surface, said first dual-rate leaf spring extending angularly between said upper and lower castings, said first dual-rate leaf spring having a fixed first effective spring rate defined by a first distance along said first surface between said upper and lower castings for rocking in a first direction and a fixed second effective spring rate defined by a second distance along a second surface between said upper and lower castings for rocking in a second direction, wherein relative pivotal motion between said upper and lower castings is limited by contact of said stop to one of said top surface of said lower casting and said bottom surface of said upper casting.

2. The rocker mechanism of claim 1, wherein said first distance is defined between a face of said upper casting and a face of said lower casting.

3. The rocker mechanism of claim 1, wherein said second distance is defined between connection points of said first dual-rate leaf spring to said upper casting and said lower casting.

4. The rocker mechanism of claim 1, further comprising a second dual-rate leaf spring interconnecting said upper and lower castings, said second dual-rate leaf spring having a first effective spring rate defined by a first distance between said upper and lower castings for rocking in a first direction and a second effective spring rate defined by a second distance between said upper and lower castings for rocking in a second direction.

5. The rocker mechanism of claim 4, wherein said first distance is defined between a face of said upper casting and a face of said lower casting.

6. The rocker mechanism of claim 4, wherein said second distance is defined between connection points of said second dual-rate leaf spring to said upper casting and said lower casting.

7. The rocker mechanism of claim 1, further comprising a plurality of stops defined by a top surface of said lower casting, wherein relative pivotal motion between said upper and lower castings is limited by contact of one of said plurality of stops to a bottom surface of said upper casting.

8. The rocker mechanism of claim 7, further comprising a plurality of boots extending between said upper and lower castings for respectively covering said plurality of stops.

9. The rocker mechanism of claim 1, wherein said first dual-rate leaf spring is preloaded for defining a relative rest position between said upper and lower castings.

10. A rocker mechanism adapted for operably interconnecting a chair to a base, comprising:

an upper casting;

a lower casting;

a stop defined in one of a top surface of said lower casting and a bottom surface of said upper casting; and first and second leaf springs interconnecting said upper and lower castings for relative pivotal motion therebetween, said first and second leaf springs each including a first surface that lies adjacent to both said upper and lower castings, said first and second leaf springs extending angularly between said upper and lower castings for maximizing a length of each of said first and second leaf springs, said upper and lower castings defining first and second effective lengths of each of said first and second leaf springs to provide fixed first and second spring rates for each of said first and second leaf springs, wherein said first spring rate is different than said second spring rate, wherein relative pivotal motion between said upper and lower castings is limited by contact of said stop to one of said top surface of said lower casting and said bottom surface of said upper casting.

11. The rocker mechanism of claim 10, wherein a first effective length of each of said first and second leaf springs is defined as a distance between faces of said upper casting and faces of said lower casting.

12. The rocker mechanism of claim 10, wherein a second effective length of each of said first and second leaf springs is defined as a distance between connection points of said first and second leaf springs to said upper casting and said lower casting.

13. The rocker mechanism of claim 10, further comprising a plurality of stops defined by a top surface of said lower casting, wherein relative pivotal motion between said upper and lower castings is limited by contact of one of said plurality of stops to a bottom surface of said upper casting.

14. The rocker mechanism of claim 13, further comprising boots associated with each of said plurality of stops extending between said upper and lower castings for respectively covering each of said plurality of stops.

15. A chair assembly comprising:

a seat frame including a seat back and a seat;

a base;

a recliner mechanism operably interconnecting said seat frame and said base such that said seat frame is positionable between an upright position and a reclined position; and a rocker mechanism adapted to operably interconnect said seat and said base, said rocker mechanism comprising:

an upper casting adapted for interconnection with the chair;

a lower casting adapted for interconnection with the base; and a first dual-rate leaf spring having a first end anchored to said upper casting and a second end anchored to said lower casting, said first dual-rate leaf spring having a fixed first effective spring rate defined by a first distance between said upper and lower castings for rocking in a first direction and a fixed second effective spring rate defined by a second distance between said upper and lower castings for rocking in a second direction.

16. The chair assembly of claim 15, wherein said first distance is defined between a face of said upper casting and a face of said lower casting.

17. The chair assembly of claim 15, wherein said second distance is defined between connection points of said first dual-rate leaf spring to said upper casting and said lower casting.

18. The chair assembly of claim 15 further comprising a recline stop mechanism defining said upright position and said reclined position.

19. The chair assembly of claim 15 further comprising a spindle assembly operably interconnecting said rocker mechanism to said seat base to provide relative swivel motion therebetween.

20. The chair assembly of claim 15, further comprising a plurality of stops defined by a top surface of said lower casting, wherein relative pivotal motion between said upper and lower castings is limited by contact of one of said plurality of stops to a bottom surface of said upper casting.

21. The chair assembly of claim 20, further comprising a plurality of boots extending between said upper and lower castings for respectively covering said plurality of stops.

22. The chair assembly of claim 15, wherein said first dual-rate leaf spring is preloaded for defining a relative rest position between said upper and lower castings.

23. A chair assembly comprising:

a seat frame including a seat back and a seat;

a base; and a rocker mechanism adapted to operably interconnect said seat and said base, said rocker mechanism including:

an upper casting adapted for interconnection with the chair;

a lower casting adapted for interconnection with the base; and first and second leaf springs interconnecting said upper and lower castings for relative pivotal motion therebetween, said first and second leaf springs extending angularly between said upper and lower castings for maximizing a length of each of said first and second leaf springs, said upper and lower castings defining first and second effective lengths of each of said first and second leaf springs to provide first and second spring rates for each of said first and second leaf springs, wherein said first spring rate is different than said second spring rate;

a recliner mechanism operably interconnecting said seat back and said seat such that said seat back is positionable between an upright position and a reclined position; and a spindle assembly operably interconnecting said rocker mechanism to said seat base to provide relative swivel motion therebetween.

* * * * *

UNITED STATES PATENT AND TRADEMARK OFFICE

CERTIFICATE OF CORRECTION

PATENT NO. : 6,827,401 B2 
DATED : December 7, 2004
INVENTOR(S) : Richard E. Marshall, Michael E. Mohn and Larry P. LaPointe It is certified that error appears in the above-identified patent and that said Letters Patent is hereby corrected as shown below:

Column 4,
Line 21, "I.e." should be -- i.e. --;
Line 26, "configure" should be -- configured --.

Column 5,
Line 10, after "may" insert -- be --;
Line 26, "includes 180" should be -- 180 includes --;
Lines 28, 30, 31 and 33, "180" should be -- 181 --;

Column 6,
Line 34, "reinforcements" should be -- reinforcement --.

Signed and Sealed this

Nineteenth Day of April, 2005

JON W. DUDAS
*Director of the United States Patent and Trademark Office*